US008737890B2

(12) United States Patent
Nakamura

(10) Patent No.: US 8,737,890 B2
(45) Date of Patent: May 27, 2014

(54) IMAGE FORMING APPARATUS WITH STEERING ROLLER AND POSITION CONTROL MECHANISM

(75) Inventor: Masakazu Nakamura, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 194 days.

(21) Appl. No.: 13/075,548

(22) Filed: Mar. 30, 2011

(65) Prior Publication Data

US 2011/0243618 A1 Oct. 6, 2011

(30) Foreign Application Priority Data

Apr. 5, 2010 (JP) ..... 2010-086723

(51) Int. Cl.
*G03G 15/01* (2006.01)
*G03G 15/00* (2006.01)

(52) U.S. Cl.
CPC ..... *G03G 15/6558* (2013.01); *G03G 15/6567* (2013.01); *G03G 2215/00143* (2013.01); *G03G 2215/00156* (2013.01); *G03G 15/6561* (2013.01); *G03G 15/657* (2013.01)
USPC ..... 399/302; 399/308; 198/806; 198/810.03

(58) Field of Classification Search
USPC ..... 399/302; 198/810.03
See application file for complete search history.

(56) References Cited

U.S. PATENT DOCUMENTS 5,090,683 A * 2/1992 Kamath et al. ..... 271/227
6,059,284 A * 5/2000 Wolf et al. ..... 271/227
7,046,947 B1 * 5/2006 Castelli et al. ..... 399/307
7,953,342 B2 * 5/2011 Nakamura et al. ..... 399/92
8,002,275 B2 * 8/2011 Hayakawa ..... 271/227
8,081,892 B2 * 12/2011 Taki et al. ..... 399/66
8,331,827 B2 * 12/2012 Kurosu ..... 399/122
8,346,140 B2 * 1/2013 Yasumoto ..... 399/302

(Continued)

FOREIGN PATENT DOCUMENTS

JP 1-172980 A 7/1989
JP 2000-34031 A 2/2000

(Continued)

OTHER PUBLICATIONS

Notification of the First Office Action for Chinese Application No. 201110083911.1; Mailing Date: Jun. 28, 2013; 10 pages, with English Translation.

(Continued)

*Primary Examiner* — David Gray
*Assistant Examiner* — Geoffrey Evans
(74) *Attorney, Agent, or Firm* — Cantor Colburn LLP

(57) ABSTRACT

An image forming apparatus including: an endless belt; a steering roller for supporting the endless belt and correcting a deviating motion of the endless belt; and a conveying section for conveying a recording material, wherein the conveying section has a position control mechanism of a recording material, and said mechanism conveys the recording material along a conveyance reference, established at a predetermined position in a width direction of the recording material, said width direction is perpendicular to a conveying direction of the recording material, wherein the steering roller is configured to be supported on a supporting point at a side on which the conveyance reference is established, and to be tilted at a side which is opposite to the side on which the conveyance reference is established, with respect to the width direction of the recording material.

6 Claims, 7 Drawing Sheets

(56) References Cited

U.S. PATENT DOCUMENTS

| | | | | |
|---|---|---|---|---|
| 8,385,794 | B2 * | 2/2013 | Yonemoto | 399/302 |
| 8,391,756 | B2 * | 3/2013 | Yasumoto | 399/299 |
| 8,391,759 | B2 * | 3/2013 | Nakura | 399/302 |
| 8,422,897 | B2 * | 4/2013 | Suzuki et al. | 399/49 |
| 8,543,036 | B2 * | 9/2013 | Nakamura | 399/121 |
| 8,588,637 | B2 * | 11/2013 | Nakamura et al. | 399/66 |
| 2006/0239733 | A1 * | 10/2006 | Choi et al. | 399/396 |
| 2007/0264066 | A1 * | 11/2007 | Peng et al. | 399/395 |
| 2008/0038004 | A1 * | 2/2008 | Inoue | 399/45 |
| 2009/0169274 | A1 * | 7/2009 | Suzuki et al. | 399/302 |
| 2010/0303495 | A1 * | 12/2010 | Kurosu | 399/68 |
| 2012/0213558 | A1 * | 8/2012 | Krucinski | 399/302 |
| 2012/0213559 | A1 * | 8/2012 | Krucinski | 399/302 |
| 2012/0328337 | A1 * | 12/2012 | Hiratsuka et al. | 399/302 |
| 2013/0058687 | A1 * | 3/2013 | Shimizu et al. | 399/302 |
| 2013/0064579 | A1 * | 3/2013 | Takahashi et al. | 399/301 |
| 2013/0064581 | A1 * | 3/2013 | Okamoto et al. | 399/302 |
| 2013/0101323 | A1 * | 4/2013 | Nakagawa | 399/302 |
| 2013/0315612 | A1 * | 11/2013 | Nishisaka et al. | 399/45 |

FOREIGN PATENT DOCUMENTS

| | | | |
|---|---|---|---|
| JP | 2002002999 | A | 1/2002 |
| JP | 2002091185 | A | 3/2002 |
| JP | 2002-148882 | A | 5/2002 |
| JP | 2002-287527 | A | 10/2002 |
| JP | 2003-1976 | A | 1/2003 |
| JP | 2003-208425 | A | 7/2003 |
| JP | 2004-78082 | A | 3/2004 |
| JP | 2004-219866 | A | 8/2004 |
| WO | 2010007928 | A1 | 1/2010 |

OTHER PUBLICATIONS

Notice of Reasons for Refusal for Japanese Patent Application No. 2010-086723, mailed Sep. 17, 2013, with English translation.

Second Office Action for the Chinese Application No. 201110083911.1 Dated Jan. 30, 2014. English translation attached.

* cited by examiner

IMAGE FORMING APPARATUS WITH STEERING ROLLER AND POSITION CONTROL MECHANISM

CROSS REFERENCE TO RELATED APPLICATION

This application is based on Japanese Patent Application No. 2010-086723 filed on Apr. 5, 2010 with the Japanese Patent Office, the entire content of which is hereby incorporated by reference.

TECHNICAL FIELD

The present invention relates to an image forming apparatus which forms an image by an electro photographic method, and in particular, to an image forming apparatus having an endless belt.

An image forming apparatus, belonging to one group, forms an image on a recording material by an image forming process, in which a toner image is formed onto a photosensitive body, then the toner image is transferred from the photosensitive body to the recording material by said process.

An image forming apparatus, belonging to another group, forms an image on a recording material by an image forming process, in which a toner image is formed on a photosensitive body, then the toner image is transferred from the photosensitive body to an intermediate transfer body, and subsequently, said toner image is transferred from the intermediate transfer body to the recording material by said process.

On the above-described image forming apparatuses, the photosensitive body and the intermediate transfer body are used as image carriers, and an endless belt is used as a conveying body for conveying the recording material.

The endless belt is entrained about a plurality of rollers, and is driven by said rollers, whereby the image forming process is conducted.

When the endless belt is rotated, a well known problem is a deviating motion of said belt. The deviating motion of the belt results in malfunctions of various such systems of the apparatuses, as well as damaged belts. Specifically, on the image forming apparatuses, resulted are not only the above matters, but also displacement of the image, including displacement of each color image. Accordingly, said deviating motion must be precisely prevented on the image forming apparatuses. Stronger emphasis must be placed on the development of anti-deviating motion technology, among various development researches of the image forming apparatuses.

To restitute the deviated belt, a steering operation is used, in which a tilted steering roller is driven. The Unexamined Japanese Patent Application Publication No. 2002-2999 discloses a technology to solve the problem in which the steering operation adversely affects image quality. That is, the problem to be solved by said patent document is to prevent the tilting movement of the steering roller from resulting in a changing velocity of the image transferring surface, including a shift of the image transfer surface. In order to solve the problem, said patent application discloses a tilting movement controlling means for controlling a tilting movement orbit of the steering roller.

Further, Unexamined Japanese Patent Application Publication No. 2002-91185 discloses a technology to solve a problem in which, since tension distribution deviates on a belt during a steering operation, a streaked concave portion or a streaked convex portion is generated at the side of the belt. Said patent application details a technology to equalize the tension distribution across the width of the belt.

In both patent applications, the steering mechanism is improved so that fluctuation of the belt surface is controlled, in which said fluctuation, such as changing velocity, displacement, and unevenness, of the belt surface, is generated while the steering operation is conducted. Therefore, the deterioration of image quality, generated when the deviating motion of the belt is corrected, is prevented. However, the control of the fluctuation of the belt surface, generated when the steering operation is conducted, has limitations for controlling actions, whereby it is very difficult for both patent applications to completely prevent the deterioration of image quality, generated when the steering operation is conducted.

Further, to effectively control the fluctuation of the belt surface, generated due to the steering operation, specific mechanisms are necessary, which result in complicated structures, and an inevitable increase in manufacturing cost.

An object of the present invention is to offer an image forming apparatus which is able to stably form an image, exhibiting high image quality, by solving the above-detailed problems in the conventional steering technology to prevent the deviating motion of the belt, and to prevent the deterioration of image quality due to the steering operation.

SUMMARY OF THE INVENTION

To achieve at least one of the abovementioned objects, an image forming apparatus reflecting one aspect of the present invention comprises: an endless belt; a steering roller for supporting the endless belt and correcting a deviating motion of the endless belt; and a conveying section for conveying a recording material, wherein the conveying section has a position control mechanism of a recording material, and said mechanism conveys the recording material along a conveyance reference, established at a predetermined position in a width direction of the recording material, said direction is perpendicular to a conveying direction of the recording material, and wherein the steering roller is configured to be supported on a supporting point at a side on which the conveyance reference is established, and to be tilted at a side which is opposite to the side on which the conveyance reference is established, with respect to the width direction of the recording material.

Concerning the effects of the present invention, the steering roller is tilted, while an end of its shaft, existing at the side of the conveyance reference, functions as a supporting point for the tilting motion. Accordingly, the deviating motion of the belt is effectively corrected. Due to the above structure, the deterioration of image quality, generated by a wavy surface of the endless belt during the steering operation, is effectively prevented, and high quality images can be stably formed on the recording material.

BRIEF DESCRIPTIONS OF THE DRAWINGS

The embodiments will now be described, by way of example only, with reference to the accompanying drawings which are meant to be exemplary, not limiting, and wherein like elements are numbered alike in the several figures, in which.

Figure 3A:
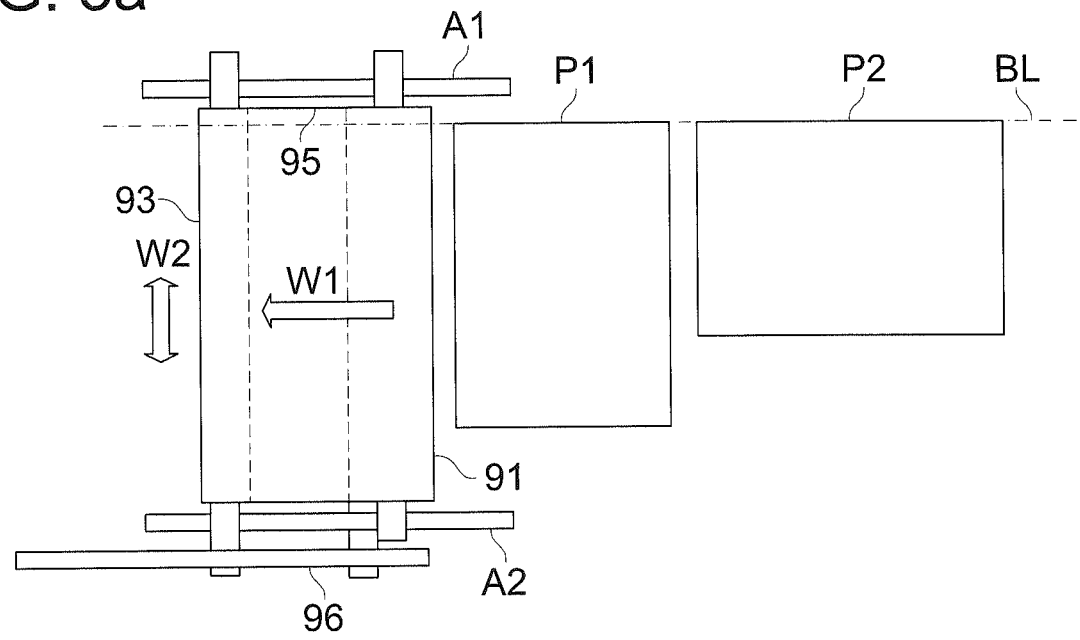
Figure 3B:
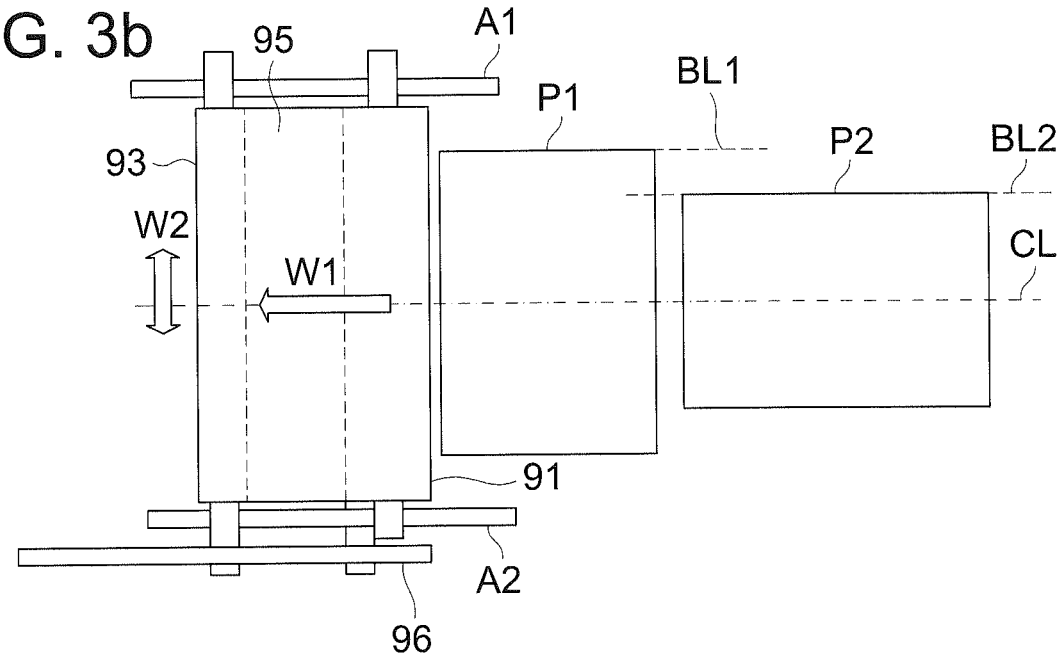
Figure 4:
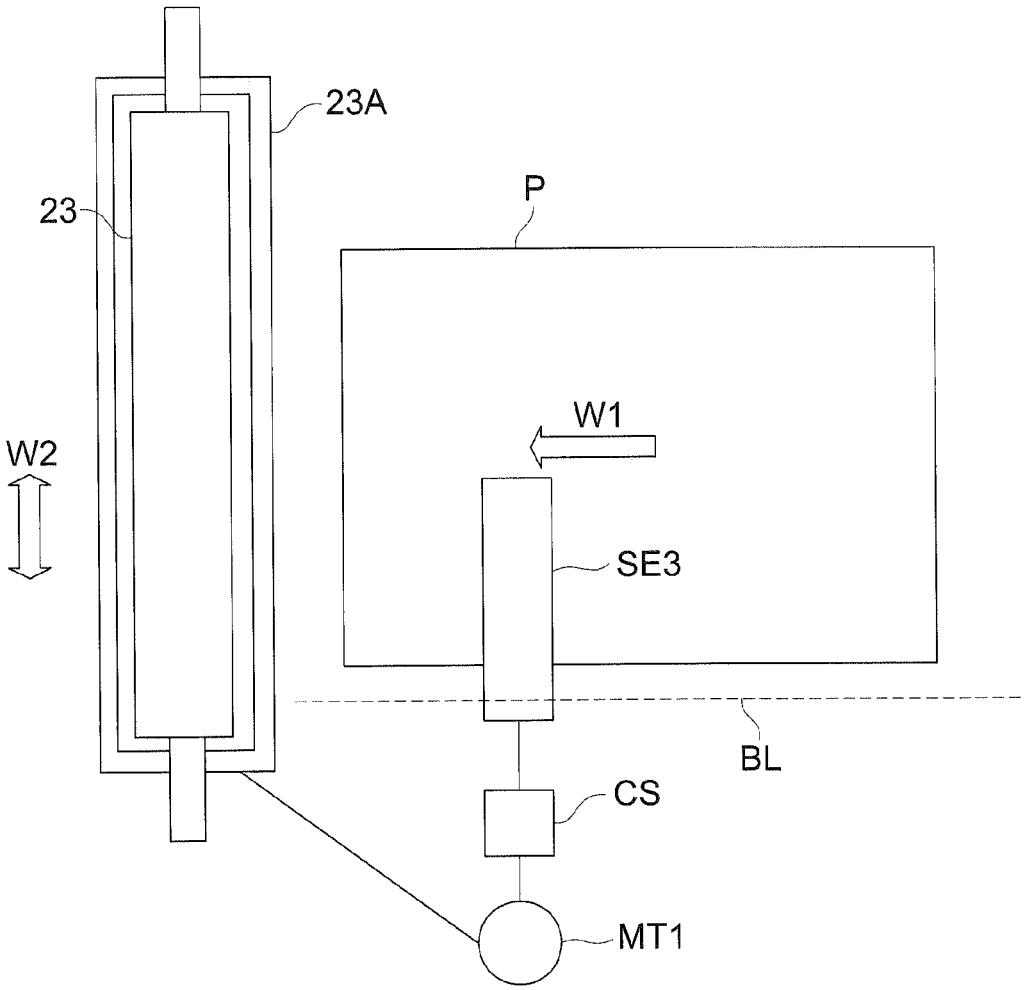
Figure 5:
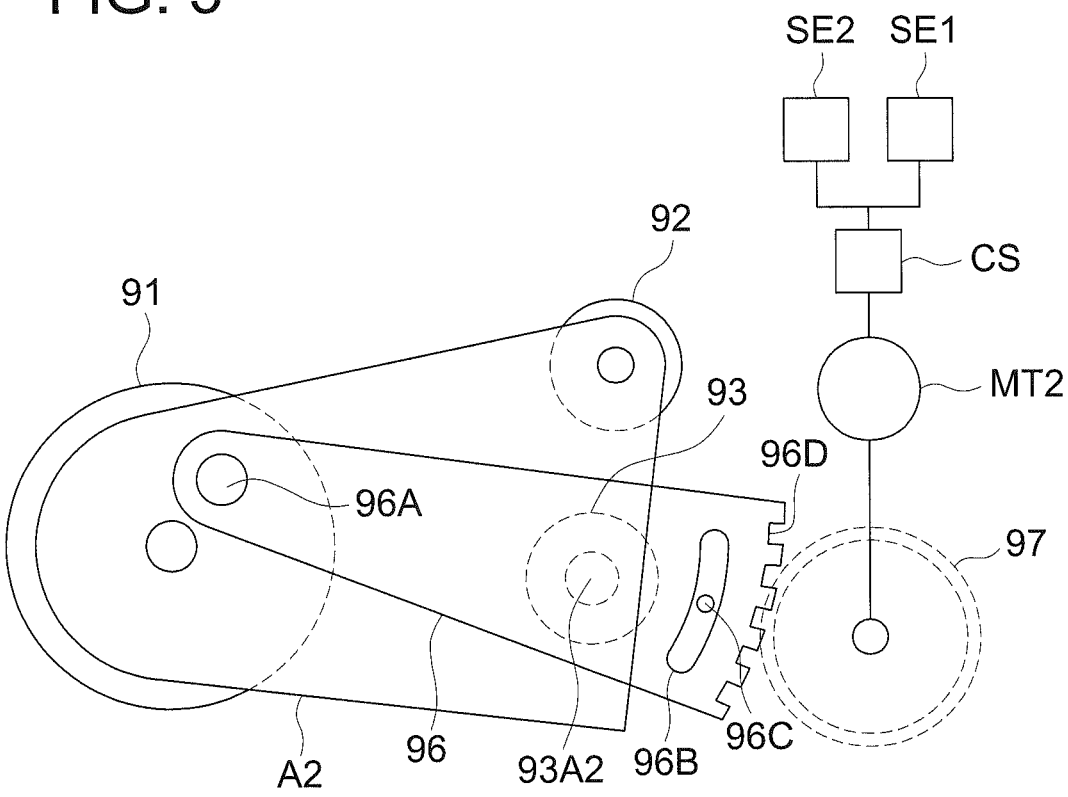
Figure 6:
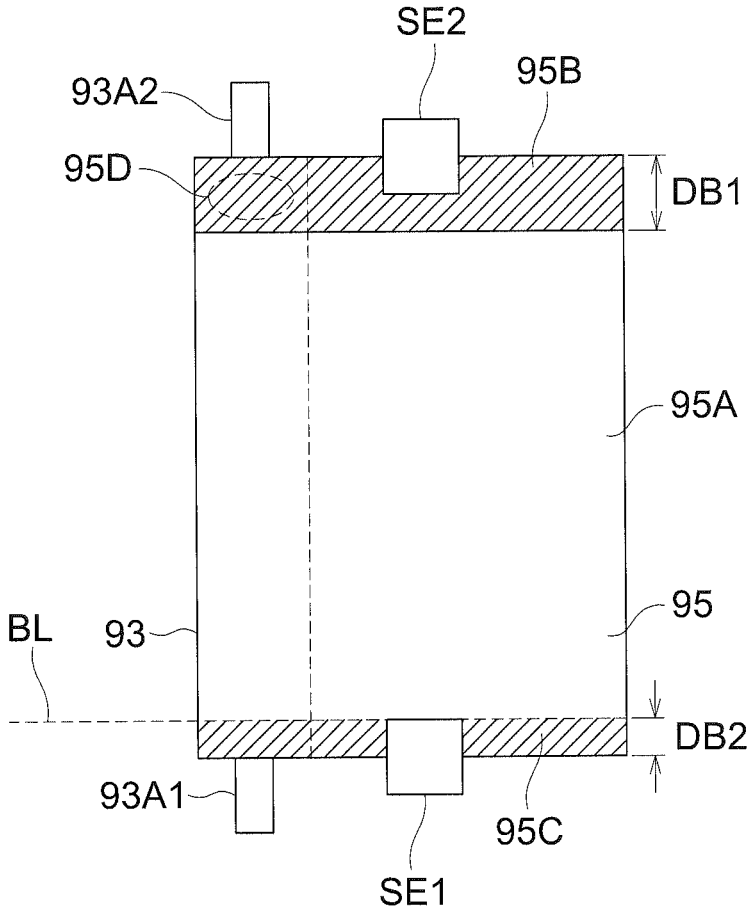

FIGS. 3*a* and 3*b* show relationships between a conveyance reference of the recording material and the recording material;

FIG. 4 shows an example of a recording material position controlling mechanism;

FIG. 5 shows an example of the steering mechanism;

FIG. 6 is a top view of the transfer belt; and

Figure 7:
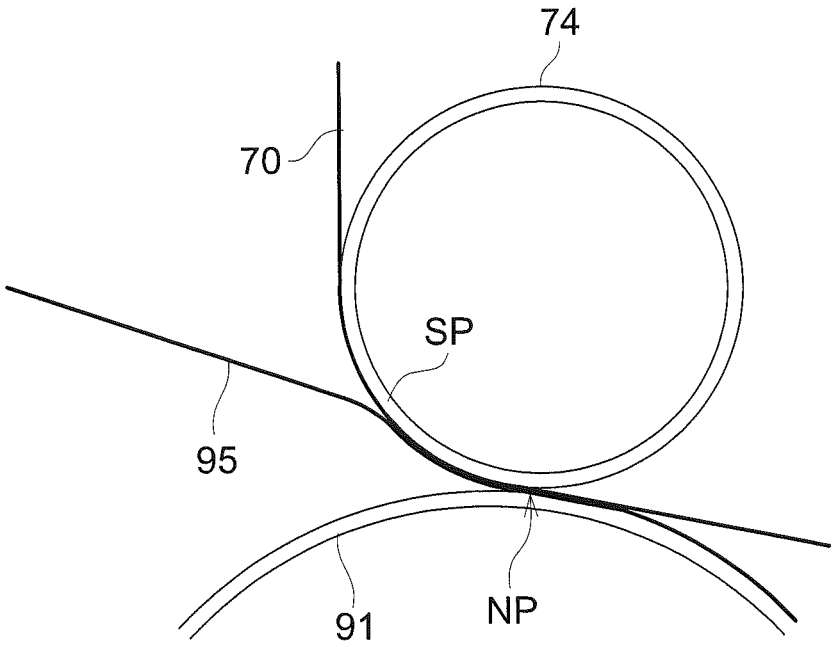

FIG. 7 is an enlarged view of a secondary transfer section.

DETAILED DESCRIPTIONS OF THE PREFERRED EMBODIMENTS

The image forming apparatus relating to the embodiments of the present invention will now be detailed, while referring to the drawings. However, the present invention is not limited to the embodiments detailed below.

<Image Forming Apparatus>

Figure 1:
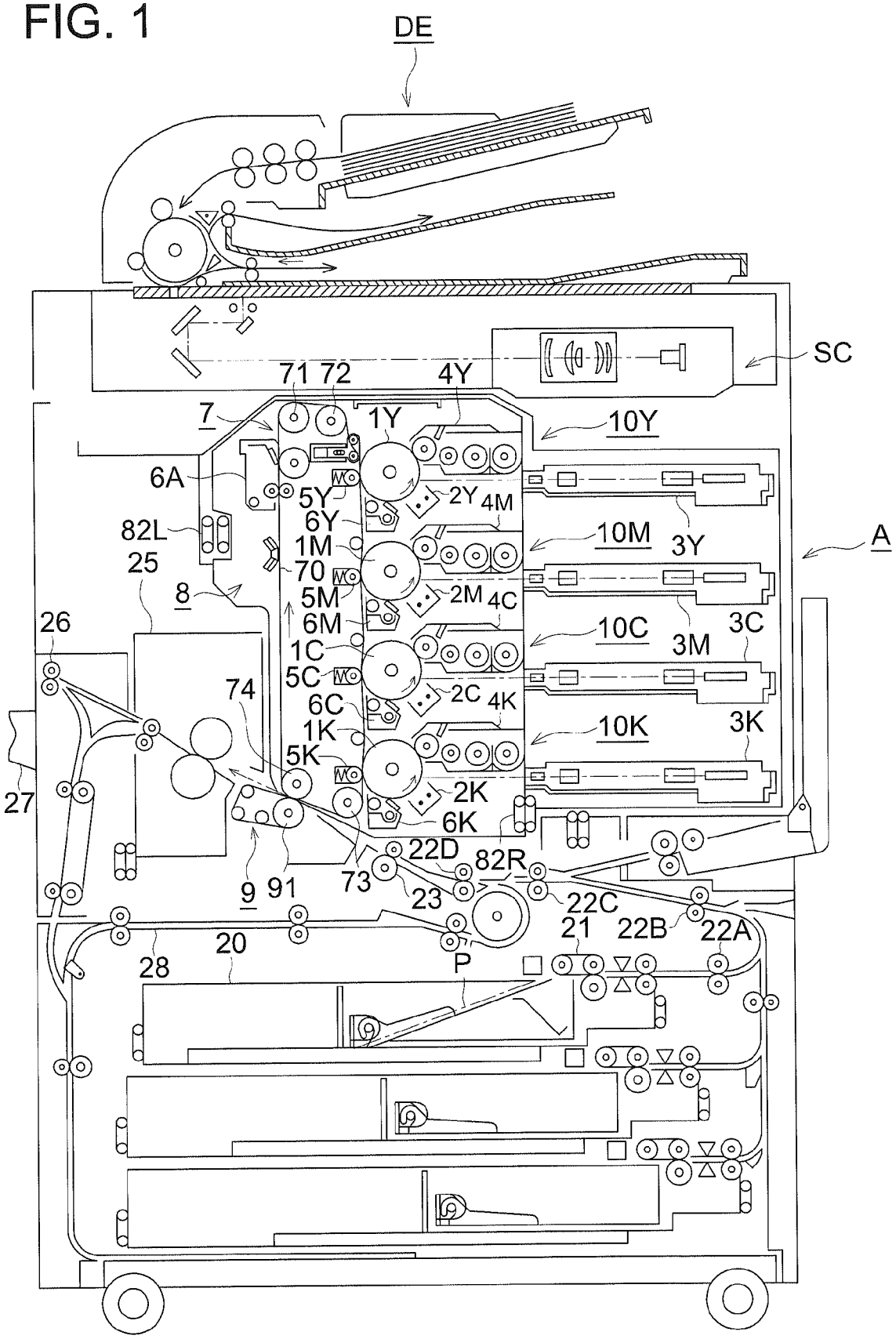
FIG. 1 shows a total structure of a full-color image forming apparatus, which is an image forming apparatus relating to an embodiment of the present invention.

FIG. 1 shows a total structure of a full-color image forming apparatus, which is an image forming apparatus relating to an embodiment of the present invention.

Full-color image fanning apparatus A is termed as a "tandem type color image forming apparatus", which is structured of plural sets of image forming units 10Y, 10M, 10C and 10K, intermediate transfer body 7, transfer unit 9, and image fixing device 25. Full-color image forming apparatus A has automatic document feeding device DF, and image reading device SC, both of which are installed at the top of full-color image forming apparatus A.

Image forming unit 10Y, which forms the yellow toner images, has drum-shaped photosensitive body 1Y, charging device 2Y, exposure device 3Y, developing device 4Y, primary transfer miler 5Y, serving as a primary transfer device, and cleaning device 6Y, all of which are arranged around photosensitive body 1Y.

Image forming unit 10M, which forms the magenta toner images, has drum-shaped photosensitive body 1M, charging device 2M, exposure device 3M, developing device 4M, primary transfer roller 5M, serving as a primary transfer device, and cleaning device 6M, all of which are arranged around photosensitive body 1M.

Image forming unit 10C, which forms the cyan toner images, has drum-shaped photosensitive body 1C, charging device 2C, exposure device 3C, developing device 4C, primary transfer roller 5Y, serving as a primary transfer device, and cleaning device 6C, all of which are arranged around photosensitive body 1C.

Image forming unit 10K, which forms the black toner images, has drum-shaped photosensitive body 1K, charging device 2K, exposure device 3K, developing device 4K, primary transfer roller 5K, serving as a primary transfer device, and cleaning device 6K, all of which are arranged around photosensitive body 1K.

Intermediate transfer unit 7 includes intermediate transfer body 70, serving as an image carrier, which is a semi-conductive endless belt, and which is entrained about a plurality of rollers 71-74, whereby rotatable intermediate transfer body 70 is supported.

Primary transfer rollers 5Y, 5M, 5C, and 5K transfer the color toner images, respectively formed by image forming units 10Y, 10M, 10C and 10K, onto rotating intermediate transfer body 70, whereby each color image is superposed, so that a full-color toner image is formed on intermediate transfer body 70.

After recording material P is supplied from any one of sheet supplying cassettes 20 by sheet conveying device 21, recording material P is conveyed to a secondary transfer position, through a conveying section, including plural intermediate rollers 22A, 22B, 22C, and 22D, as well as paired registration rollers 23.

At the secondary transfer position, the full-color toner image is totally transferred onto recording material P by transfer electric voltage TE (see FIG. 2), which is applied on roller 74, serving as a back-up roller.

Recording material P, carrying the full-color toner image, is processed by fixing device 25, including a heated roller and a pressure roller. Subsequently, said recording material P is sandwiched by ejection rollers 26, and conveyed onto tray 27.

After transfer roller 91 has transferred the full-color toner image onto recording material P, intermediate transfer body 70 separates recording material P using a sharp-angle separation method. After that, cleaning section 8A removes any stray toner particles remaining on intermediate transfer body 70.

Numeral 28 represents a reverse surface supplying section. For image formation on both surfaces, an image formation is conducted on the first surface of recording material P. After recording material P is processed by fixing device 25, recording material P is conveyed to reverse surface supplying section 28, subsequently conveyed to paired registration rollers 23.

During the image formation, primary transfer roller 5K is always in contact with photosensitive body 1K. Other primary transfer rollers 5Y, 5M, and 5C are in contact with photosensitive bodies 1Y, 1M, and 1C, respectively, only when the full-color image formation is conducted.

Transfer roller 91 is in contact with intermediate transfer body 70, only when the secondary transfer operation is conducted onto recording material P by transfer roller 91.

Further, box body 8 is drawn out from forming apparatus A through supporting rails 82L and 82R. Box body 8 includes image forming units 10Y, 10M, 10C and 10K, as well as intermediate transfer body unit 7. When box body 8 is drawn out by the operator, image forming units 10Y, 10M, 10C and 10K, as well as intermediate transfer body unit 7, are drawn out as a single unit from image forming apparatus A.

<Transfer Unit>

Figure 2:
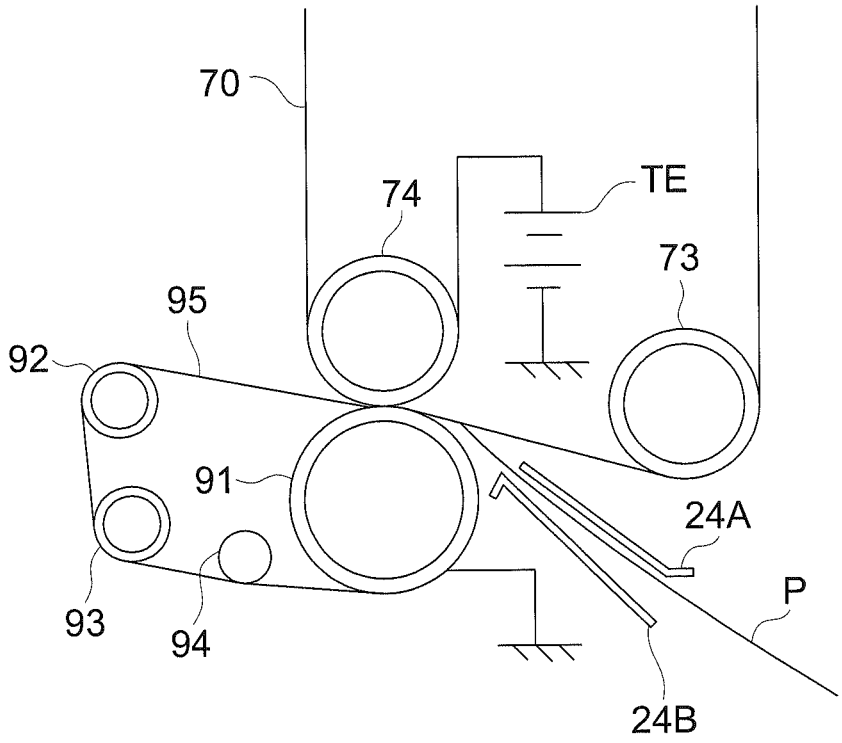
FIG. 2 shows a transfer unit and its adjacent parts.

FIG. 2 shows a transfer unit and its adjacent parts

Transfer unit 9 includes transfer roller 91, serving as a secondary transfer device, driving roller 92, steering roller 93, tension roller 94, and transfer belt 95, which is an endless belt. Transfer belt 95 is entrained about transfer roller 91, driving roller 92, steering roller 93, and tension roller 94. Transfer roller 91 is a roller covered with an electro-conductive rubber layer. Transfer belt 95 is an endless belt exhibiting a volume resistivity of $10^{12}$ Ωcm to $10^{15}$ Ωcm. Transfer belt 95 is formed of resins, such as modified polyimide, thermal curing polyimide, ethylene tetrafluoroethylene copolymer or, polyvinylidene-fluoride, or nylon alloy, or a rubber, which is a film of a thickness of 0.1 mm to 1.0 mm, on which an electro-conductive material is dispersed. Transfer belt 95 is an elastic belt, with a coefficient of elasticity of 0-3 GPa. As detailed below, the deviating motion of transfer belt 95 is restituted by the steering operation. During the steering operation, the flatness of transfer belt 95 is effectively secured between transfer roller 91 and driving roller 92, due to the elasticity of the belt.

Intermediate transfer body 70 and transfer belt 95 are nipped between roller 74, serving as a backup roller, and transfer roller 91. Transfer voltage is applied onto roller 74 from transfer power supply TE, at a bottom portion of intermediate transfer unit 7. Recording material P, conveyed to the secondary transfer position by guide members 24A and 24B, is nipped and conveyed by intermediate transfer body 70 and transfer belt 95.

Transfer roller 91 is electrically grounded. Transfer belt 95 is rotated by driving roller 92. Recording material P is conveyed by rotating transfer belt 95, so that a full-color toner image, formed on the intermediate transfer body 70, is transferred onto recording material P.

<Conveyance Reference>

The conveyance reference of the recording material will be detailed below.

The recording material must be conveyed on a predetermined orbit of image forming apparatus A. If the recording material is conveyed out of the predetermined orbit, jamming is generated on the recording material, and the position of the formed image is adversely shifted.

In order to convey the recording material on the predetermined orbit, in the width direction which is perpendicular to the conveying direction of the recording material, a conveyance reference is established by a position controlling mechanism for the recording material, which is detailed below, whereby the recording material is conveyed based on said conveyance reference. The conveyance reference will be detailed below, while referring to FIGS. 3*a* and 3*b*. The position controlling mechanism for the recording material is provided on a conveying section which conveys recording material P to the secondary transfer position.

FIGS. 3*a* and 3*b* show relationships between the conveyance reference of recording material P and the recording material. FIGS. 3*a* and 3*b* show transfer unit 9, viewed from below in FIG. 2.

FIG. 3*a* shows a so-called one-sided reference adjusting method. All recording materials P are conveyed to meet reference line BL, which is a conveyance reference, established on one side of width direction W2 (which is perpendicular to the conveying direction W1). In FIG. 3*a*, to convey recording material P1 and P2, whose widths W2 are different to each other, the top edges of recording materials P1 and P2 are adjusted to reference line BL.

FIG. 3*b* shows relationships between recording material P and transfer unit 9, when recording material P is conveyed by a so-called center reference adjusting method.

By the center reference adjusting method, various sizes of recording materials P are conveyed, while being secured to be in line symmetry with respect to center line CL1. That is, recording materials P1 and P2 are conveyed, so that their centers, in width direction W2, are adjusted to center line CL1. Also, in case of the center reference adjusting method, the conveyance references BL1 and BL2 are established to meet one side of width direction W2, whereby the position of recording material P is secured in width direction W2.

That is, in case of the center reference adjusting method, the conveyance reference of recording material P1 is established on reference line BL1, while the conveyance reference of recording material P2 is established on reference line BL2.

FIG. 4 shows an example of the recording material position controlling mechanism.

When recording material P is conveyed to paired registration rollers 23 (See FIG. 1), the edge of recording material P is detected by sensor SE3. Sensor SE3 determines how many millimeters recording material P is shifted from the conveyance reference, for example.

Based on the above shifted length, control section CS activates motor MT1 to move frame 23A, which supports paired registration rollers 23, in width direction W2, whereby the positional shift of recording material P is corrected. Paired registration rollers 23, having nipped recording material P, are shifted in width direction W2 by motor MT2, so that recording material P is adjusted to the conveyance reference, and conveyed.

By the above-described shifting operation, the edge of recording material P is adjusted to reference lines BL, BL1, and BL2, and recording material P is conveyed by paired registration rollers 23 to the secondary transfer position.

The recording material position control mechanism is not limited to use the sensor. For example, a guide member, having a guide surface, can also control the position of the recording material.

<Steering Operation>

Steering roller 93 is driven to be tilted by the steering mechanism shown in FIG. 5, so that the deviating motion of transfer belt 95 is effectively corrected. FIG. 5 is a side view of transfer unit 9, which is viewed from the back of image forming apparatus A.

Transfer roller 91 and driving roller 92 are supported by front supporting frame A1 and back supporting frame A2, of image forming apparatus A. Steering roller 93 is supported by front frame A1 at the front side of image forming apparatus A, and is also supported by supporting lever 96 at the back side of image forming apparatus A.

Supporting lever 96 is rotatably supported by shaft 96A mounted on back supporting frame A2. Supporting lever 96 supports steering roller 93 rotatably mounted on shaft 93A2. Arched hole 96B, whose arch is centered on shaft 96A, is formed on supporting lever 96. Pin 96C is inserted through arched hole 96B, so that supporting lever 96 rotates around shaft 96A, while being guided by pin 96C.

Toothed portion 96D is provided on the right side of supporting lever 96, and tooth portion 96D engages gear 97, so that supporting lever 96 can be rotated by gear 97.

The transfer belt is deviated in the width direction, during rotation. In FIG. 6, when the deviation increases to a threshold level, sensors SE1 and SE2, which are configured to detect the edge of transfer belt 95, detect that transfer belt 95 has adversely deviated. By detection signals, generated by sensors SE1 and SE2, control section CS activates motor MT2, so that gear 97 is rotated. Due to the rotation of gear 97, supporting lever 96 is rotated, whereby the deviation of transfer belt 95 is corrected. Accordingly, steering roller 93 can be tilted and rotated, while an end, supported by front supporting frame A1, functions as a supporting point, and the other end, supported by back supporting frame A2, functions as a tilting end.

<Prevention of Wavering during Steering Operation, and Prevention of Decreasing of Image Quality due to Wavering>

By the steering operation, the deviation of the belt is corrected, whereby the recording material is conveyed, and the image is transferred onto the recording material. That is, steering roller 93 is tilted and rotated, while one end of steering roller 93, supported by front supporting frame A1, functions as a supporting point, and the other end, supported by back supporting frame A2, is tilted. Due to this operation, the tension distribution on transfer belt 95, generated in the width direction perpendicular to the moving direction of transfer belt 95, is regulated, whereby any deviation of transfer belt 95 can be corrected. However, when the steering operation is conducted, adverse waves are generated on transfer belt 95. In detail, during the steering operation, transfer belt 95 is wavered by the tilting end of steering roller 93, that is, in FIG. 5, transfer belt 95 forms a wave at the end portion of steering roller 93, supported by supporting lever 96.

Referring to FIG. 6, said waves will be detailed. FIG. 6 is a top view of transfer belt 95. Both edges of transfer belt 95 are detected by sensors SE1 and SE2. The lower placed side of FIG. 6 represent the front side of image forming apparatus A (see FIG. 1), while an upper placed side represents the back side of image forming apparatus A. Front shaft 93A1 of steering roller 93 serves as a supporting point, while back shaft 93A2 is driven to be tilted so that the steering operation is conducted. During the steering operation, transfer belt 95 forms a wave at end portion 95D.

Said waves adversely generate transfer problems, which result in deterioration of image quality.

In the present invention, the supporting point of the tilting motion of steering roller 93 is established at the conveyance reference side, while the tilting end of steering roller 93 is established at the opposite side of the conveyance reference, with respect to the width direction. By these establishments, the deterioration of image quality, due to the wavering motion of transfer belt 95, is effectively reduced.

In the present invention, the conveyance reference, detailed by FIG. 3, is established as below. The relationships between the conveyance reference and transfer belt 95 will be detailed below, while referring to FIGS. 3*a* and 3*b*, as well as FIG. 6.

Under the one-sided reference adjusting method, which is shown in FIG. 3*a*, recording material P is conveyed, based on a single conveyance reference, which is reference line BL. Further, under the center reference adjusting method, which is shown in FIG. 3*b*, recording material P is conveyed, based on different conveyance references, which are reference lines BL1 and BL2, in accordance with the sizes of recording materials P. The conveyance of recording material P is conducted, not to deviate from the conveyance reference toward the outside of the conveying route. However, slight deviation toward the inside of the conveying route may be allowable to some degree. That is, the conveyance of recording material P is controlled not to deviate upward from reference lines BL, BL1, and BL2, in FIG. 3, while to deviate downward from reference lines BL, BL1, and BL2 may be allowable to some degree.

The width of transfer belt 95 is determined, based on said conveyance control of recording material P. The width of transfer belt 95 is determined so that widest recording material P can be supported and conveyed. That is, the width of transfer belt 95 is determined, so that the width of transfer belt 95 can cover all the imaging area, on which the maximum sized image is formed. In fact, the width of transfer belt 95 is determined to include a non-imaging area which is added to the imaging area, as well as the imaging area.

FIG. 6 shows imaging area 95A, non-imaging area 95B (which is first non-imaging area), and non-imaging area 95C (which is second non-imaging area). Width DB1 of non-imaging area 95B is greater than width DB2 of non-imaging area 95C. Non-imaging area 95B is established on a side carrying no conveyance reference, while non-imaging area 95C is established on a side carrying conveyance reference BL.

In addition, FIG. 6 shows a case of the one-sided reference adjusting method shown in FIG. 3*a*, wherein conveyance reference BL, being a single line, is used. However, in case of the center reference adjusting method, shown in FIG. 3*b*, a single line is also used, wherein the width of the non-imaging area, established on the side carrying the conveyance reference, is less than the width of the non-imaging area, established on the side carrying no conveyance reference.

As detailed above, width DB1 of non-imaging area 95B is less than width DB2 of non-imaging area 95C. Accordingly, the conveyance control can be conducted, in which while recording material P is conveyed along the conveyance reference, recording material P cannot deviate outside the conveyance reference.

When non-imaging areas 95B and 95C, having different widths to each other, are to be established at both sides of transfer belt 95, if a wavering end portion is formed on the conveyance reference side, on which narrow non-imaging area 95C has been established, wavering transfer belt 95 adversely allows the image quality to deteriorate. If a wavering end portion is established on the end portion on which wider non-imaging area 95B has been established, and which exists at a side opposite to the conveyance reference, the deterioration of image quality due to wavering transfer belt 95 can be effectively controlled. FIG. 6 shows that wide non-imaging area 95B is established on the filling end portion of transfer belt 95, whereby, end portion 95D, on which wavering tends to occur, is completely included within non-imaging area 95B.

FIG. 6 shows that, the non-imaging area, which is outside the area where the biggest size image is formed, has been established to be wider at the wavering end portion. Due to this establishment, deterioration of image quality can be effectively controlled.

The tilting end of the steering operation is established at an opposite side to the conveyance reference, so that the deterioration of image quality is effectively controlled, which will be detailed, while referring to FIG. 7, showing an enlarged view of the secondary transfer section.

Toner images on intermediate transfer body 70 are transferred onto recording material P at transferring nip NP, which is formed by transfer roller 91 and roller 74.

After recording material P has passed through transferring nip NP, recording material P is necessary to separate from intermediate transfer body 70. In the image forming apparatus shown in FIG. 1, the so-called sharp-angle separation method is used to separate recording material P from intermediate transfer body 70. Since the diameter of roller 74 is rather small, after recording material P has passed through transferring nip NP, recording material P is flat due to its rigidity, whereby, recording material P is conveyed to go straight, after separated form intermediate transfer body 70, which is bent and moves along the surface of roller 74.

In FIG. 7, transfer belt 95 moves, while winding around intermediate transfer body 70 from transfer nip NP to point SP, and transfer belt 95 separates from intermediate body 70 at point SP. Drive roller 92 is arranged at a position which is higher than the position of transfer nip NP, so that transfer belt 95 winds around backup roller 74, for a predetermined length, at the downstream of transfer nip NP, (see FIG. 2). Recording material P is conveyed, while being nipped between intermediate transfer body 70 and transfer belt 95, from transfer nip NP to point SP. Due to this structure, recording material P is securely directed to straighten at point SP.

As result, recording material P can certainly separate from intermediate transfer body 70, which is driven to be bent along roller 74.

That is, since transfer belt 95 is configured to wind around roller 74, downstream of transfer nip NP, separation of recording material P can be certainly conducted by the sharp-angle separation method.

However, concerning the sharp angle separation method, using transfer belt 95, the wavering movement of transfer belt 95 adversely effects image quality.

As detailed before, since the tilting side of steering roller 93 is arranged opposite to the conveyance reference, deterioration of image quality does not occur, and image formation can be normally conducted, in case of the sharp angle separation method shown in FIG. 7.

Concerning the above-detailed image forming apparatus, the steering operation of the transfer belt to convey the recording material is conducted at the transfer position, and deterioration of image quality, due to the wavering movement during the steering operation, is effectively prevented. Further, it is also possible to apply the above detailed present invention to the wavering movement of intermediate transfer body 70, formed of an endless belt, whereby deterioration of image quality, due to the wavering movement during the steering operation against intermediate transfer body 70, can be effectively prevented.

Concerning the steering operation of intermediate transfer body 70, roller 72 in FIG. 1 serves as a steering roller, for example. In this case, the tilting side of roller 72, about which intermediate transfer body 70 is entrained, is arranged opposite to the conveyance reference of the recording material.

Further, the present invention can also be applied onto an image forming apparatus using a photoconductive body, formed of an endless belt.

What is claimed is:

1. An image forming apparatus comprising:

an endless belt;

a steering roller for supporting the endless belt and correcting a deviating motion of the endless belt; and a conveying section for conveying a recording material, wherein the conveying section has a sensor to detect one of side edges of the recording material in a width direction which is perpendicular to a conveying direction of the recording material, wherein the sensor is configured to detect a shifting length of the recording material from a conveyance reference; and a position control mechanism of the recording material, wherein the position control mechanism conveys the recording material along the conveyance reference, established at a predetermined position, in the width direction of the recording material, and wherein the steering roller is supported on a supporting point at a side on which the conveyance reference is established wherein the sensor is provided on said side, and the steering roller is tilted at a side which is opposite to the side on which the conveyance reference is established, with respect to the width direction of the recording material.

2. The image forming apparatus of claim 1, wherein the endless belt is configured to convey the recording material at a transfer position.

3. The image forming apparatus of claim 2, further comprising:

an image carrier;

a backup roller for supporting the image carrier; and a transfer roller, wherein a transfer nip is formed between the backup roller and the transfer roller, to nip the image carrier, the recording material, and the endless belt, wherein the endless belt is configured to wind around the backup roller, at a position more downstream than the transfer nip in the conveying direction of the recording material.

4. The image forming apparatus of claim 1, wherein the endless belt is configured to carry a toner image.

5. The image forming apparatus of claim 1, wherein the endless belt is formed of an elastic belt.

6. The image forming apparatus of claim 1, wherein a first non-imaging area is formed on an edge, to which the steering roller is tilted, of the endless belt, and a second non-imaging area is formed on an edge opposite to the first non-imaging area, wherein a width of the first non-imaging area is greater than a width of the second non-imaging area.

* * * * *